US011758991B1

(12) United States Patent
Hegde et al.

(10) Patent No.: US 11,758,991 B1
(45) Date of Patent: Sep. 19, 2023

(54) STRETCHABLE STRANDS FOR FABRIC ITEMS

(71) Applicant: Apple Inc., Cupertino, CA (US)

(72) Inventors: Siddhartha Hegde, San Jose, CA (US); Rimple Bhatia, Woodside, CA (US); Yohji Hamada, Wakayamashi (JP); Joseph B. Walker, Campbell, CA (US)

(73) Assignee: Apple Inc., Cupertino, CA (US)

( * ) Notice: Subject to any disclaimer, the term of this patent is extended or adjusted under 35 U.S.C. 154(b) by 403 days.

(21) Appl. No.: 16/553,951

(22) Filed: Aug. 28, 2019

Related U.S. Application Data

(60) Provisional application No. 62/730,784, filed on Sep. 13, 2018.

(51) Int. Cl.
*A44C 5/00* (2006.01)
*D02G 3/32* (2006.01)

(52) U.S. Cl.
CPC ..... *A44C 5/0053* (2013.01); *D02G 3/32* (2013.01); *D10B 2331/04* (2013.01); *D10B 2401/061* (2013.01)

(58) Field of Classification Search
CPC ..... A44C 5/0053; A44C 5/0069; D10B 2331/04; D10B 2401/061; D02G 3/38; D02G 3/32; D02G 3/442; D03D 1/00; D03D 15/00; D03D 15/283; D03D 15/43; D03D 15/56
USPC ..... 442/1, 2, 5, 49, 181–303; 428/357–407, 428/100
See application file for complete search history.

(56) References Cited

U.S. PATENT DOCUMENTS

| | | | | |
|---|---|---|---|---|
| 2,030,610 A | | 2/1936 | Randall | |
| 2,076,270 A | | 4/1937 | Harris | |
| 3,130,630 A | | 4/1964 | Dawes | |
| 5,448,779 A | * | 9/1995 | Aldridge | A62B 17/001 2/243.1 |
| 5,809,861 A | * | 9/1998 | Hummel | D04C 1/12 87/8 |

(Continued)

FOREIGN PATENT DOCUMENTS

| | | | | |
|---|---|---|---|---|
| JP | H0892801 A | * | 4/1996 | A41B 11/00 |
| JP | 2007169795 A | * | 7/2007 | |

OTHER PUBLICATIONS

Recron FR, Reliance Industries Limited, 2017. (Year: 2017).*

(Continued)

*Primary Examiner* — Matthew D Matzek
*Assistant Examiner* — Braelyn R Watson
(74) *Attorney, Agent, or Firm* — Treyz Law Group, P.C.; Kendall P. Woodruff

(57) ABSTRACT

A fabric strap may be configured to attach an electronic device to a user's body. Some of the strands in the fabric strap may be stretchable strands. A stretchable strand may include an elastic core covered by one or more layers of material. The elastic core may be formed from a single elastic strand or may be formed from multiple elastic strands. The first layer of material on the elastic core may be a strand that is twisted around the elastic core. The second layer of material on the elastic core may be a strand that is braided around the first layer of material and the elastic core. The first layer may have a thickness that is greater than that of the elastic core and the second layer of material. The first and second layers of material may be formed from non-stretchable or stretchable materials.

18 Claims, 7 Drawing Sheets

(56) References Cited

U.S. PATENT DOCUMENTS

| | | | | |
|---|---|---|---|---|
| 6,250,193 | B1 | 6/2001 | Head | |
| 7,947,367 | B2 | 5/2011 | Poon et al. | |
| 7,955,539 | B2 | 6/2011 | Patel et al. | |
| 2006/0105658 | A1* | 5/2006 | Patz | D03D 15/513 442/181 |
| 2007/0141937 | A1 | 6/2007 | Hendrix et al. | |
| 2012/0060262 | A1* | 3/2012 | Herman | A41F 3/00 2/326 |
| 2016/0249685 | A1* | 9/2016 | Blasi | A41D 27/20 2/127 |
| 2019/0203385 | A1 | 7/2019 | Agzikara et al. | |

OTHER PUBLICATIONS

Shippee, Eric, Estimating the Diameter of Industrial Sewing Thread and Yarn, Service Thread, Apr. 18, 2018. https:// www.servicethread.com/blog/how-to-estimate-yarn-diameter-and-denier-size (Year: 2018).*

Technical Guide for NOMEX Brand Fiber, DuPont, 2001 (Year: 2001).*

Recron Polyester Staple Fibre Safety data sheet, Reliance Industries Limited, 2019 (Year: 2019).*

English translation of JPH0892801A obtained from Espacenet (Year: 1996).*

Geng, Qian, et al. "Relationship between fiber fineness and diameter of three bast fibers." Journal of Natural Fibers (2021): 1-8 ("Geng"). (Year: 2021).*

Flame Retardancy, Sew What?, 2017. (Year: 2017).*

Production of fireproof yarns, Pozzi Electa, 2021 (Year: 2021).*

English translation of JP 2007169795 A obtained from Google Patents (Year: 2007).*

Modacrylic fiber, Physical and Chemical Properties, Cameo, 2020. (Year: 2020).*

Estimating the Diameter of Industrial Sewing Thread and Yarn, Equation on p. 2, Service Thread, 2022. (Year: 2022).*

* cited by examiner

STRETCHABLE STRANDS FOR FABRIC ITEMS

This application claims the benefit of provisional patent application No. 62/730,784, filed Sep. 13, 2018, which is hereby incorporated by reference herein in its entirety.

FIELD

This relates generally to fabric items and, more particularly, to fabric items for electronic devices.

BACKGROUND

Items such as wristwatches have wrist straps. Straps may be formed from materials such as metal, plastic, and fabric. It can be challenging to obtain an appropriate amount of stretch in a fabric item. If care is not taken, fabrics may not have sufficient elasticity, and stretchable fabrics may not be comfortable against a user's skin.

SUMMARY

Items such as electronic devices with straps may include fabric. For example, a strap for a wristwatch may be formed from fabric.

Some of the strands in a fabric strap may be stretchable strands. A stretchable strand may include an elastic core covered by one or more layers of material. The elastic core may be formed from a single elastic strand or may be formed from multiple elastic strands. The first layer of material on the elastic core may be a strand that is twisted around the elastic core. The second layer of material on the elastic core may be a strand that is braided around the first layer of material and the elastic core. The first layer may have a thickness that is greater than that of the elastic core and the second layer of material. The first and second layers of material may be formed from non-stretchable or stretchable materials.

DETAILED DESCRIPTION

Electronic devices may be provided with fabric. The fabric may be used to form straps or other fabric items for an electronic device. The fabric may be woven fabric or knit fabric or may be formed by intertwining strands of material using braiding techniques or other intertwining techniques. The electronic devices may be wristwatches, fitness bands, or other electronic devices. Illustrative configurations in which portable electronic devices such as wristwatch devices or other wrist-mounted portable electronic devices are provided with woven fabric straps may sometimes be described herein as an example. In general, any suitable portable electronic device may be provided with a strap and the strap may be formed from any suitable fabric material. The straps or other fabric structures may be used to attach the portable electronic device to an arm, leg, head, torso, wrist, or other portion of a user's body.

Figure 1:
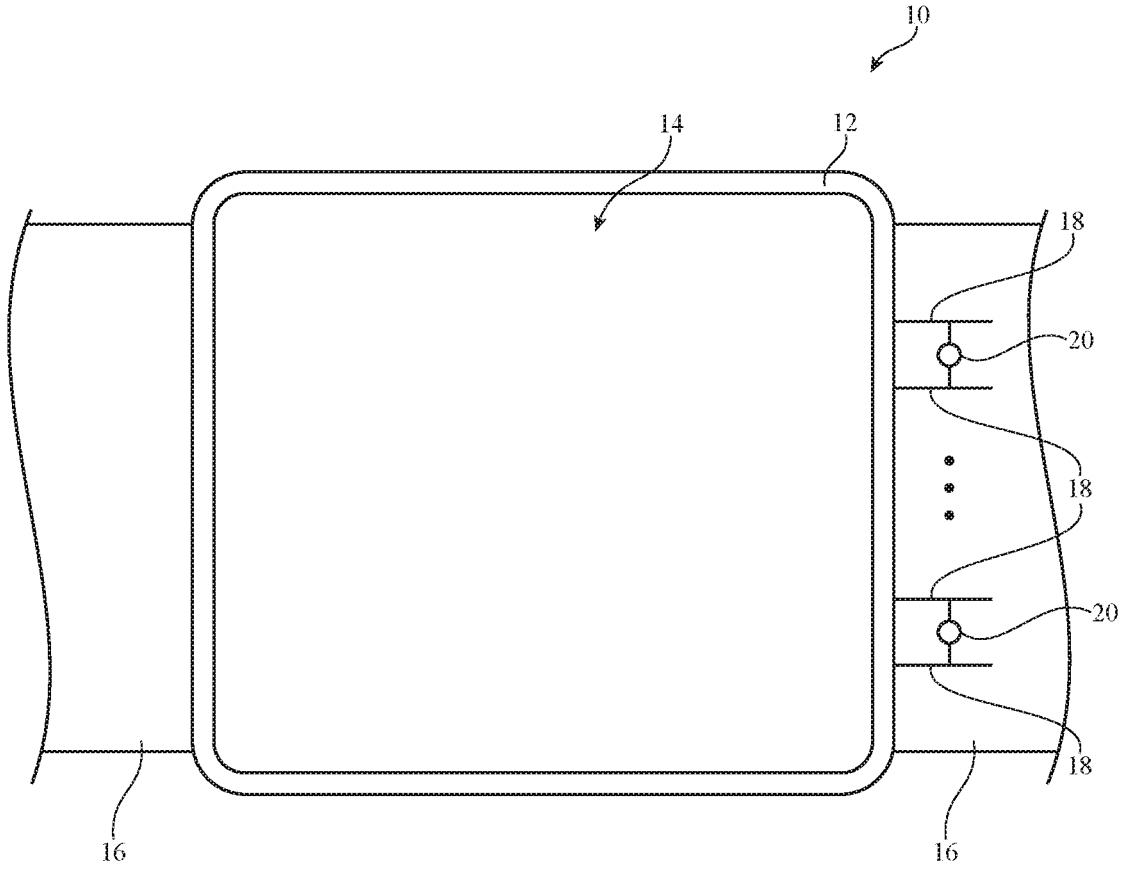
FIG. 1 is a top view of an illustrative electronic device with a fabric strap in accordance with an embodiment.

An illustrative electronic device is shown in FIG. 1. As shown in FIG. 1, device 10 may have a display such as display 14 and other electrical components mounted in a housing such as housing 12. Device 10 may be a portable electronic device such as a device that is mounted on a user's wrist, arm, leg, head, torso, or other body part. Device 10 may, for example, be a wrist-mounted device such as a wristwatch, a health monitoring device, a media player, a wireless key, or other electronic device and/or equipment that includes the functions of two or more of these devices or other suitable devices. Housing 12 (e.g., a watch housing in scenarios in which device 10 is a wristwatch) may be formed from metal, ceramic, plastic, glass, sapphire or other crystalline materials, and/or other suitable materials. Housing 12 may have a rectangular outline, may have an oval or circular shape, or may have other suitable shapes. Display 14 may be a liquid crystal display, an organic light-emitting diode display, or other suitable display.

Strap 16 may have portions attached to opposing sides of housing 12. Strap 16 may be coupled to pins or other structures that are attached to the exterior of housing 12 (as an example). A clasp formed from hook-and-loop fasteners or other suitable clasp may be used to secure strap 16 about the wrist or other body part of a user.

Strap 16 may include strands of material that are woven together. The strands of material that are woven to form strap 16 may be monofilaments and/or multifilament yarns. Strap 16 may contain insulating strands of material and/or conductive strands of material.

Insulating strands may be formed from dielectric materials such as polymers. Conductive strands may be formed from metal wires or may be formed from one more conductive layers of material such as metal layers on polymer cores or other polymer layers. Conductive strands may also be formed by mixing conductive filaments with insulating filaments. Conductive strands may have insulating coatings.

If desired, strap 16 may contain electrical components such as components 20. Components 20 may include sensors, buttons, light-emitting diodes, batteries, antennas, integrated circuits, vibrators and other actuators, and/or other input-output devices. Conductive strands of material such as strands 18 may be used in routing power and data signals between components 20 within strap 16 and between components such as component 20 in strap 16 and circuitry in housing 12.

Figure 2:
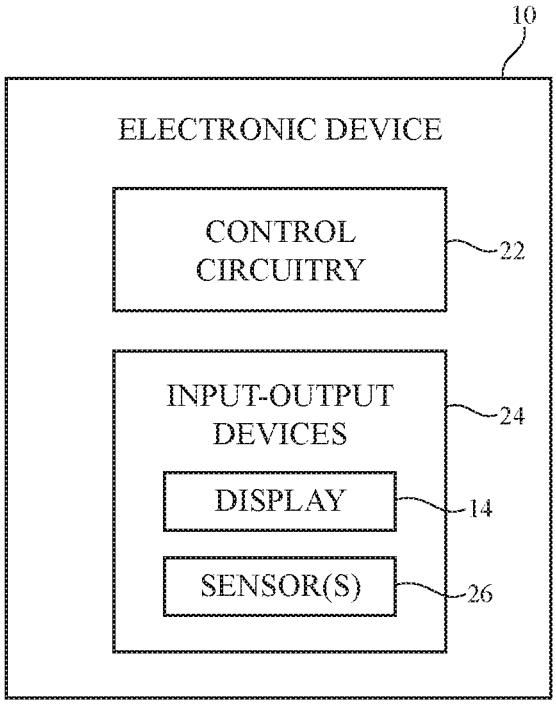
FIG. 2 is a schematic diagram of an illustrative electronic device in accordance with an embodiment.

A schematic diagram of an illustrative electronic device such as device 10 of FIG. 1 is shown in FIG. 2. As shown in FIG. 2, device 10 may include control circuitry 22. Control circuitry 22 may include processing circuitry such as microprocessors, digital signal processors, microcontrollers, baseband processors, image processors, application-specific integrated circuits with processing circuitry, and/or other processing circuitry and may include random-access memory, read-only memory, flash storage, hard disk storage, and/or other storage (e.g., a non-transitory storage media for storing computer instructions for software that runs on control circuitry 22).

Device 10 may include electrical components in housing 12 and/or in strap 16 that form input-output circuitry such as input-output devices 24. Input-output devices 24 may be used to allow data to be supplied to device 10 from external devices and from a user and to allow data to be provided from device 10 to external devices and the user. Input-output devices 24 may include buttons, joysticks, scrolling wheels, touch pads, key pads, keyboards, microphones, speakers, tone generators, vibrators, haptic devices, cameras, light-emitting diodes and other status indicators, displays such as display 14, data ports, etc. Sensors 26 of input-output devices 24 may include touch sensors, force sensors, accelerometers, compasses, magnetic sensors, gas sensors, pressure sensors, temperature sensors, capacitive proximity sensors, light-based proximity sensors, digital image sensors, ambient light sensors, heart rate sensors and blood oxygen sensors (e.g., sensors having a light emitter that emits light into a user's skin and the detects and processes reflected light), and other sensing circuits.

Device 10 may include wireless circuitry (e.g., wireless transceivers, antennas, etc.) for supporting wireless local area network communications, cellular telephone communications, near field communications, wireless power transmission and reception operations, and other wireless communications and power transfer operations.

Figure 3:
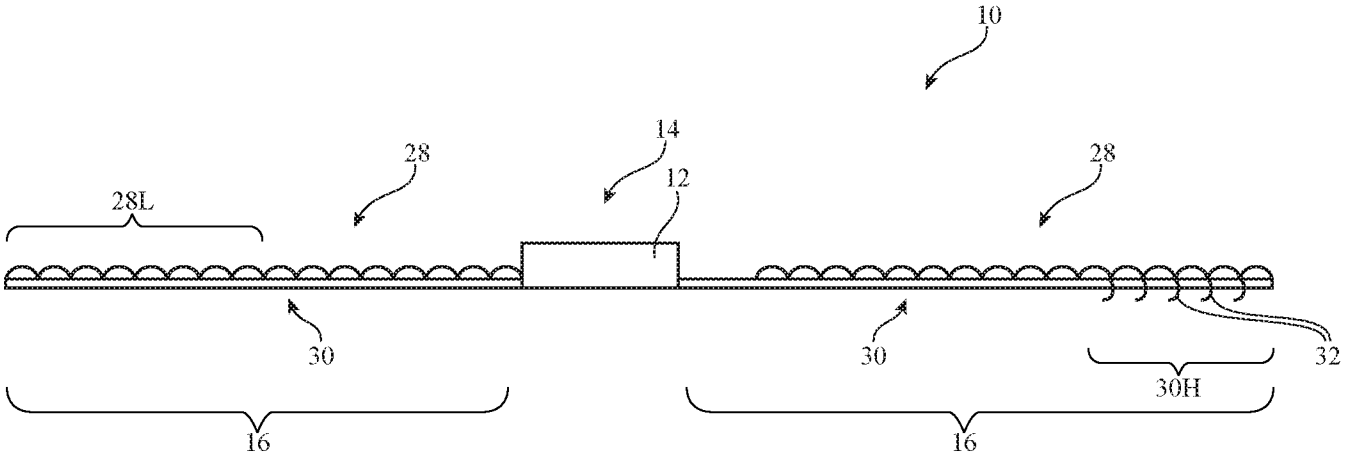
FIG. 3 is a cross-sectional side view of an illustrative electronic device with a wrist strap in accordance with an embodiment.

A cross-sectional side view of an illustrative device such as device 10 of FIG. 1 is shown in FIG. 3. As shown in FIG. 3, strap 16 may have an outer surface (front side) such as outer surface 28 and may have an opposing inner surface (rear side) such as inner surface 30. A clasp for strap 16 may be formed using magnets, interlocking prongs and holes, snaps, or other clasp mechanisms. With one illustrative configuration, which is shown in FIG. 3, strap 16 has a clasp formed from mating hook-and-loop fasteners. Portion 30H of inner surface 30 of strap 16 may have hooks 32 and at least portion 28L on the outer surface of strap 16 may have mating loops. If desired, most or all of outer surface 28 of strap 16 may have loops (e.g., so that outer surface 28 has a uniform appearance).

Figure 4:
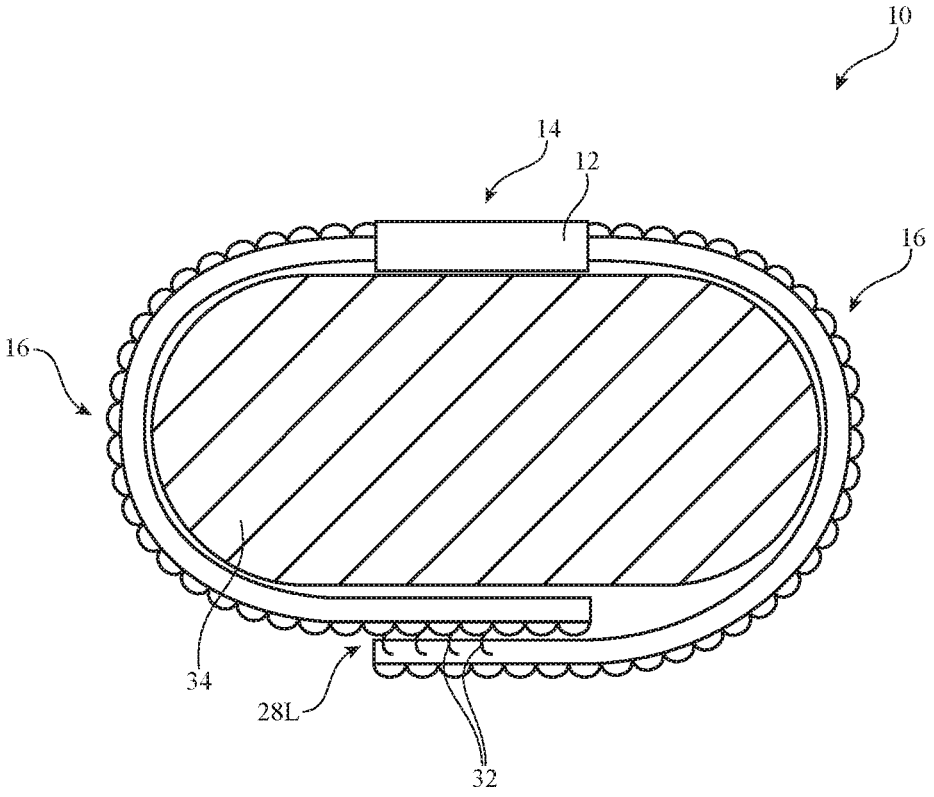
FIG. 4 is a cross-sectional side view of the illustrative electronic device of FIG. 3 in a configuration in which the wrist strap has been wrapped around a user's wrist in accordance with an embodiment.

As shown in FIG. 4, when strap 16 is wrapped around a user's wrist or other body part such as wrist 34, hooks 32 engage the loops of portion 28L and thereby close the hook-and-loop fastener formed from hooks 32 and the loops of portion 28L. When it is desired to open the clasp formed from the hook-and-loop fastener of strap 16, a user may pull outwardly on the end of strap 16 that is adjacent to hooks 32, thereby pulling hooks 32 away from the mating loops on portion 28L of strap 16.

The loops that are formed in region 28L of surface 28 may, if desired, be formed from portions of the strands of material that are woven to form strap 16 (i.e., the strands of material that are used in forming strap 16 may have portions that extend outwardly from the rest of the fabric forming strap 16 so that these loop portions may be engaged by hooks 32). Hooks 32 may be individually incorporated into strand 16 or may be mounted on a fabric strip or other support layer that is attached to strap 16 with adhesive, by sewing, by welding (e.g., laser welding), by intertwining the strands of material that form strap 16 with hooks 32, by crimping hooks 32 to strap 16, by molding hooks 32 to strap 16, or by using other suitable attachment mechanisms. Hooks 32 may be formed from metal, from plastic, from portions of the strands of material in fabric 16, or from other suitable materials.

Figure 5A:
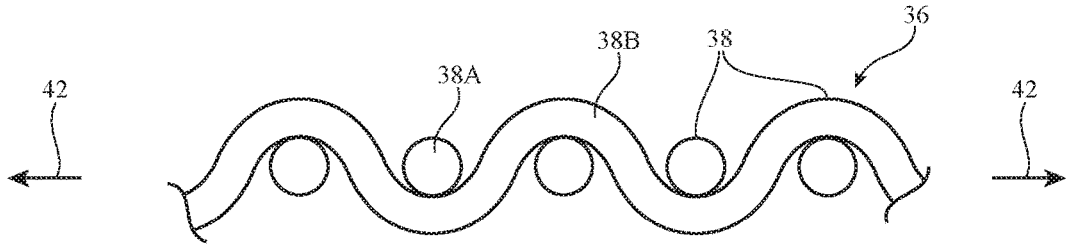
FIG. 5A is a cross-sectional side view of an illustrative fabric layer in a strap in an unstretched configuration in accordance with an embodiment.
Figure 5B:
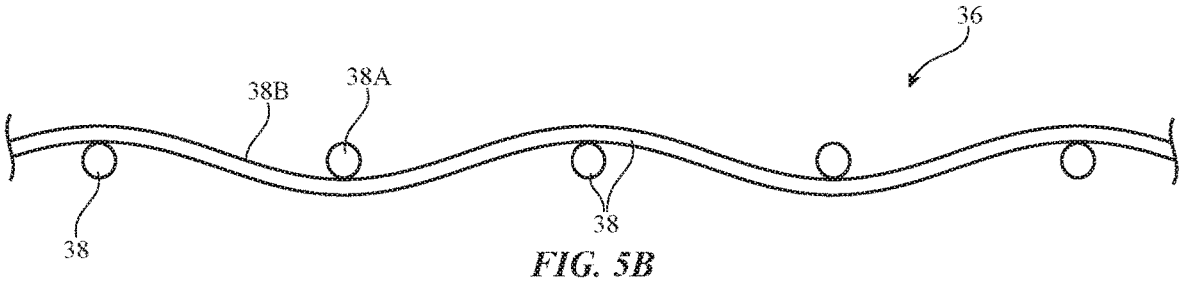
FIG. 5B is a cross-sectional side view of the fabric layer of FIG. 5A in a stretched configuration in accordance with an embodiment.

The fabric that forms strap 16 may have one or more stretchable layers. Consider, as an example, the illustrative fabric of FIG. 5A. Fabric 36 has strands 38 such as weft strands 38A and warp strands 38B. Warp strands 38B (and, if desired, some or all of weft strands 38A) may be formed from stretchable material such as stretchable polyurethane, spandex, silicone, or other stretchable material. Due to the presence of stretchable warp strands 38B, fabric 36 may stretch when pulled in directions 42, as illustrated in FIG. 5B. Stretchable strands such as warp strands 38B may be oriented to run around the user's wrist (i.e., the warp strands in straps 16 may be oriented so that they extend along the elongated longitudinal dimension of strap 16). This allows a user to stretch strap 16 tightly around wrist 34 or other body part (e.g., to ensure that a satisfactory heart rate monitor signal is picked up by a heart rate monitor in device 10, etc.). If desired, the fabric forming strap 16 may contain non-stretchable strands of material (e.g., polyester, etc.). Non-stretchable strands of material may, for example, be used to provide strap 16 with strength and/or moisture management capabilities.

Illustrative examples of stretchable strands that may be used in fabric such as fabric 36 of strap 16 are shown in FIGS. 6, 7, 8, 9, 10, and 11.

Figure 6:
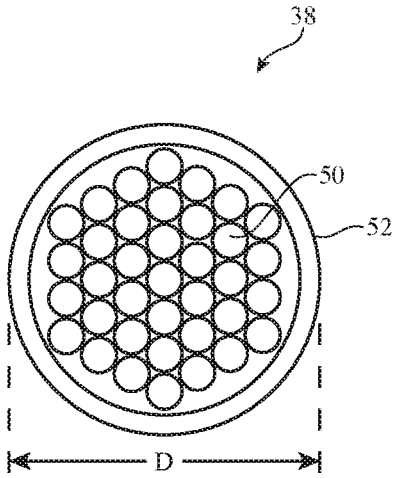
FIG. 6 is a cross-sectional side view of an illustrative stretchable strand having an elastic core formed from a bundle of elastic strands in accordance with an embodiment.

In the example of FIG. 6, stretchable strand 38 is formed from a bundle of elastic strands 50 covered in a non-elastic material such as non-elastic material 52. Each elastic strand 50 may be formed from elastic material such as natural rubber, synthetic rubber, nitrile rubber, silicone rubber, urethane rubbers such as polyurethane, spandex, chloroprene rubber, ethylene-vinyl acetate, polyolefin elastomer, polytrimethylene terephthalate, thermoplastic elastomers such as polyester-polyether copolymers, polyamide-polyether copolymers, other elastomers, other rubbers, and/or a combination of any two or more of these materials. There may be five, ten, fifteen, twenty, more than twenty, or less than twenty elastic strands 50 bundled in strand 38 of FIG. 6.

Non-elastic material 52 may be polyester or other non-stretchable material. Non-elastic material 52 may include one or more strands of material that are braided around elastic strands 50, twisted (e.g., wrapped) around elastic strands 50, or otherwise covering or partially covering the bundle of elastic strands 50. If desired, non-elastic material 52 may be a coating rather than a strand (e.g., a coating that is deposited onto strand 38, a coating that strand 38 is dipped into, or other suitable coating).

It can be challenging to incorporate strands that are sufficiently stretchable into a fabric that is worn against a user's skin. If there are too many elastic strands 50 bundled together in strand 38, strand 38 may not be sufficiently stretchable. The elastic modulus (Young's modulus) of strand 38 of FIG. 6 can be reduced by using fewer elastic strands 50 in strand 38. However, fewer elastic strands 50 within strand 38 may lead to a reduced diameter D of strand 38. If the diameter D of strand 38 is too small, fabric 36 that incorporates strands 38 may be uncomfortable for users because of the reduced surface area of strands 38 that is in contact with the user's skin.

Figure 7:
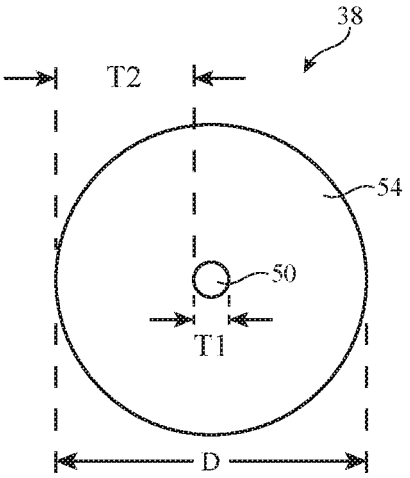
FIG. 7 is a cross-sectional side view of an illustrative stretchable strand having an elastic core covered by a layer of material in accordance with an embodiment.

To increase the elasticity of strands 38 without reducing the diameter of strands 38, strands 38 may have a configuration of the type shown in FIG. 7. In the example of FIG. 7, stretchable strand 38 has a single elastic strand 50 at its core. Elastic strand 50 is covered with material 54. Material 54 may be elastic material (e.g., natural rubber, synthetic rubber, nitrile rubber, silicone rubber, urethane rubbers such as polyurethane, spandex, chloroprene rubber, ethylene-vinyl acetate, polyolefin elastomer, polytrimethylene terephthalate, thermoplastic elastomers such as polyester-polyether copolymers, polyamide-polyether copolymers, other elastomers, other rubbers, and/or a combination of any two or more of these materials), may be non-elastic material (e.g., polyester, etc.), or may be a combination of elastic and non-elastic materials. Material 54 may include one or more strands of material that are twisted around elastic strand 50, braided around elastic strand 50, or otherwise covering or partially covering elastic strand 50. If desired, material 54 may be a coating rather than a strand (e.g., a coating that is deposited onto strand 38, a coating that strand 38 is dipped into, or other suitable coating).

Material 54 is configured to fill a space around elastic strand 50 to achieve the desired diameter D (e.g., a diameter that is equal or close to the diameter D of strand 38 of FIG. 6). In some arrangements, material 54 may be one or more strands of non-elastic material that is twisted around elastic strand 50. A twisted type of covering may be more stretchable than a braided layer. In this way, material 54 can be sufficiently thick to achieve the appropriate diameter D without compromising the stretchiness of strand 38.

Material 54 may, if desired, consume most of the volume of strand 38. The appropriate thickness of material 54 may be achieved by using a thick, low density material (e.g., a fuzzy material), using multiple layers of twisted coverings (e.g., one, two, three, or more than three covering layers), and/or selecting strands with an appropriate denier value (e.g., between 1,800 denier and 2000 denier or other suitable denier value). The thickness T2 of material 54 may be greater than the diameter T1 of elastic core 50.

Figure 8:
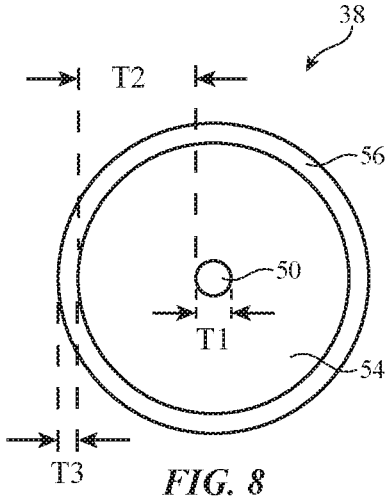
FIG. 8 is a cross-sectional side view of an illustrative stretchable strand having an elastic core covered by first and second layers of material in accordance with an embodiment.

FIG. 8 shows an arrangement in which strand 38 includes a single elastic strand 50 at its core, a middle layer of material 54, and an outer layer of material 56.

Middle layer of material 54 may be elastic material (e.g., natural rubber, synthetic rubber, nitrile rubber, silicone rubber, urethane rubbers such as polyurethane, spandex, chloroprene rubber, ethylene-vinyl acetate, polyolefin elastomer, polytrimethylene terephthalate, thermoplastic elastomers such as polyester-polyether copolymers, polyamide-polyether copolymers, other elastomers, other rubbers, and/or a combination of any two or more of these materials), may be non-elastic material (e.g., polyester, etc.), or may be a combination of elastic and non-elastic materials. Material 54 may include one or more strands of material that are twisted around elastic strand 50, braided around elastic strand 50, or otherwise covering or partially covering elastic strand 50. If desired, material 54 may be a coating rather than a strand (e.g., a coating that is deposited onto strand 38, a coating that strand 38 is dipped into, or other suitable coating).

Outer layer of material 56 may be elastic material (e.g., natural rubber, synthetic rubber, nitrile rubber, silicone rubber, urethane rubbers such as polyurethane, spandex, chloroprene rubber, ethylene-vinyl acetate, polyolefin elastomer, polytrimethylene terephthalate, thermoplastic elastomers such as polyester-polyether copolymers, polyamide-polyether copolymers, other elastomers, other rubbers, and/or a combination of any two or more of these materials), may be non-elastic material (e.g., polyester, etc.), or may be a combination of elastic and non-elastic materials. Material 56 may include one or more strands of material that are braided around elastic strand 50 and middle layer of material 54, twisted around elastic strand 50 and middle layer of material 54, or otherwise covering or partially covering elastic strand 50 and middle layer of material 54. If desired, material 56 may be a coating rather than a strand (e.g., a coating that is deposited onto strand 38, a coating that strand 38 is dipped into, or other suitable coating).

In one illustrative arrangement, middle layer of material 54 is formed from one or more strands that are twisted around elastic strand 50, and outer layer of material 56 is formed from one or more strands that are braided around elastic strand 50 and middle layer 54. With this type of arrangement, middle layer of material 54 may be used to achieve the desired diameter of strand 38 (e.g., by consuming the bulk of the volume in strand 38), but may remain sufficiently stretchable due to the fact that the strands of material 54 are twisted around elastic strand 50. Outer layer 56 may be used to impart a desired texture to the outer surface of strand 38 (and thus the outer surface of fabric 36), may be used to provide moisture-wicking (e.g., by using strands with different denier values than that of middle layer 54), may be used to provide electrical insulation (e.g., in arrangements where strand 38 has conductive portions that convey electrical signals), may serve as a moisture barrier, and/or may serve other purposes.

As in the example of FIG. 7, material 54 of FIG. 8 is configured to fill a space around elastic strand 50 to achieve the desired strand diameter (e.g., a diameter that is equal or close to the diameter D of strand 38 of FIG. 6). Material 54 may be sufficiently thick to achieve the appropriate diameter D without compromising the stretchiness of strand 38. The thickness T2 of the middle layer of material 54 may be greater than the thickness T3 of outer layer of material 56 and may also be greater than the diameter T1 of elastic core 50. The appropriate thickness of material 54 may be achieved by using a thick, low density material (e.g., a fuzzy material), using multiple layers of twisted coverings (e.g., one, two, three, or more than three covering layers, such as covering layers 54A and 54B of FIG. 11), and/or selecting strands with an appropriate denier value (e.g., between 1,800 denier and 2000 denier or other suitable denier value).

Figure 9:
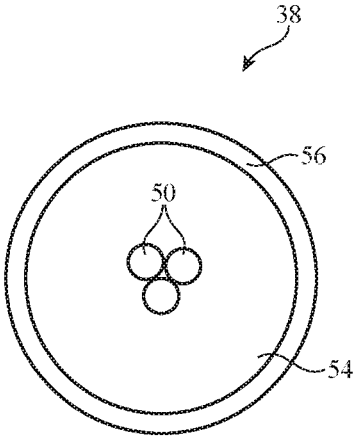
FIG. 9 is a cross-sectional side view of an illustrative stretchable strand having an elastic core formed from multiple elastic strands that are covered by first and second layers of material in accordance with an embodiment.

The example of FIGS. 7 and 8 in which strand 38 includes only a single elastic strand 50 at its core is merely illustrative. If desired, strand 38 may include one, two, three, four, five, ten, more than ten, or less than ten elastic strands 50 at its core. FIG. 9 shows an illustrative arrangement with three elastic strands 50 at the core of strand 38. The three elastic strands 50 are covered with middle layer of material 54 (e.g., a covering formed from strands of material 54 that are twisted around elastic strands 50) and outer layer of material 56 (e.g., strands of material 56 that are braided around elastic strands 50 and middle layer of material 54). This example is merely illustrative. In general, strand 38 may include any suitable number of elastic strands 38 at its core.

Figure 10:
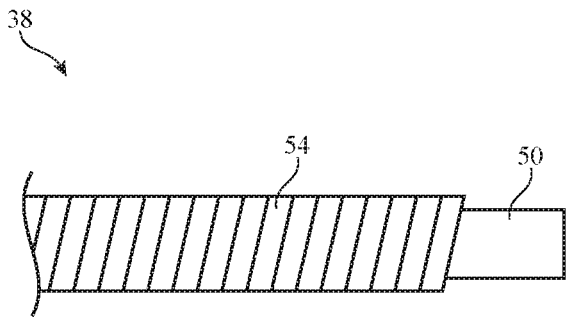
FIG. 10 is a side view of an illustrative stretchable strand having an elastic core and a covering formed from a strand of material that is twisted around the elastic core in accordance with an embodiment.

FIG. 10 is a side view of an illustrative strand 38 with high elasticity (low Young's modulus) and a sufficiently large strand diameter. As shown in FIG. 10, strand 38 may have one or more elastic strands 50 at its core. Strands of material 54 may be twisted around elastic strand 50 (e.g., in a Z-twist direction or an S-twist direction). Strands of material 54 may have any suitable number of turns per meter (e.g., 1000 turns per meter, 1500 turns per meter, 2000 turns per meter, 2500 turns per meter, 3000 turns per meter, greater than 3000 turns per meter, less than 300 turns per meter, etc.). Strands of material 54 may be covered with a braided layer (e.g., as in the example of FIGS. 8 and 9) or may be left uncovered (e.g., as in the example of FIG. 7).

Figure 11:
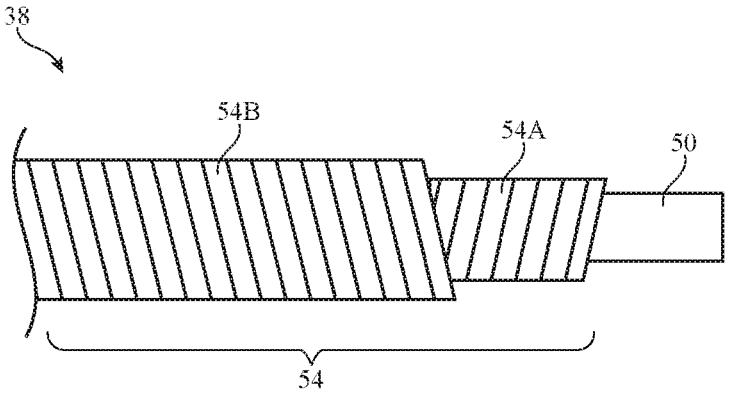
FIG. 11 is a side view of an illustrative stretchable strand having an elastic core and first and second coverings formed from strands of material that are twisted around the elastic core in accordance with an embodiment.

In the example of FIG. 11, strands of material 54 are used to form first and second coverings such as inner covering 54A and outer covering 54B. Inner covering 54A and outer covering 54B may have the same characteristics or may have different characteristics (e.g., may have different numbers of turns per meter, may be formed from different materials, may be twisted in different twist directions, may have different denier values to achieve a moisture-wicking effect, etc.). For example, inner covering 54A may have a first twist direction (e.g., a Z-twist direction) and a first number of turns per meter (e.g., 2000 turns per meter) and outer covering 54B may have a second twist direction (e.g., an S-twist direction) and a second number of turns per meter (e.g., 2000 turns per meter). This is, however, merely illustrative. In general, the layers of material 54 such as layers 54A and 54B may have any suitable twist direction and any suitable number of turns per meter (e.g., 1000 turns per meter, 1500 turns per meter, 2000 turns per meter, 2500 turns per meter, 3000 turns per meter, greater than 3000 turns per meter, less than 300 turns per meter, etc.).

Strands of material 54 may be covered with a braided layer (e.g., as in the example of FIGS. 8 and 9) or may be left uncovered (e.g., as in the example of FIG. 7).

The example of FIG. 11 in which material 54 forms two covering layers is merely illustrative. If desired, layers of material 54 may form three, four, more than four, or less than four layers of covering on elastic strand 50 at the core of strand 38.

With fewer elastic strands 50 in strand 38 (e.g., strand 38 of FIGS. 7, 8, 9, 10, and 11), strand 38 may have a lower Young's modulus than strand 38 of FIG. 6 while still maintaining a sufficiently large strand diameter. The elasticity of strand 38 can be modified by changing the number of elastic strands 50 at the core of strand 38, changing the diameter of elastic strands 50 at the core of strand 38, changing the number of layers of material 54, changing the types of materials used for strands 50, 54, and/or 56, changing the denier value of strands 50, 54, and/or 56, etc.

The foregoing is merely illustrative and various modifications can be made to the described embodiments. The foregoing embodiments may be implemented individually or in any combination.

What is claimed is:

1. A fabric strap for an electronic device configured to be worn by a user, comprising:
- weft strands; and
- warp strands intertwined with the weft strands, wherein the warp strands comprise a stretchable strand having a core and wherein the stretchable strand comprises:
  - an elastic strand at the core,
  - a first strand twisted around the elastic strand, and
  - a second strand braided around the elastic strand and the first strand, wherein the first strand forms a first layer having a first thickness and the second strand forms a second layer having a second thickness that is less than the first thickness, wherein the stretchable strand has a volume defined by the elastic strand, the first strand, and the second strand, and wherein the first strand consumes more of the volume than the elastic strand and more of the volume than the second strand.

2. The fabric strap defined in claim 1, wherein the first strand comprises a non-stretchable material.

3. The fabric strap defined in claim 2 wherein the non-stretchable material comprises polyester.

4. The fabric strand defined in claim 1 wherein the elastic strand has a diameter and wherein the first thickness is greater than the diameter.

5. The fabric strap defined in claim 1 wherein the elastic strand is the only elastic strand in the stretchable strand.

6. The fabric strap defined in claim 1 wherein the elastic strand is one of fewer than ten elastic strands in the stretchable strand.

7. The fabric strap defined in claim 1 wherein the second strand comprises non-stretchable material.

8. The fabric strap defined in claim 7 wherein the non-stretchable material comprises polyester.

9. The fabric strap defined in claim 1 further comprising a hook-and-loop fastener.

10. A stretchable layer of fabric for attaching an electronic device to a user's body, comprising:
- a first set of strands; and
- a second set of strands intertwined with the first set of strands, wherein at least one of the first and second sets of strands includes a stretchable strand comprising:
  - an elastic core,
  - a first layer of material surrounding the elastic core, and
  - a second layer of material surrounding the first layer of material and the elastic core, wherein the first layer of material has a greater thickness than the elastic core, wherein the stretchable strand has a volume defined by the elastic core, the first layer of material, and the second layer of material, and wherein the first layer of material consumes more of the volume than the elastic core and more of the volume than the second layer of material.

11. The stretchable layer of fabric defined in claim 10 wherein the first layer of material has a greater thickness than the second layer of material.

12. The stretchable layer of fabric defined in claim 10 wherein the first and second layers of material comprise non-elastic material.

13. The stretchable layer of fabric defined in claim 12 wherein the first layer of material comprises a first strand twisted around the elastic core and wherein the second layer of material comprises a second strand braided around the first strand.

14. The stretchable layer of fabric defined in claim 10 further comprising a hook-and-loop fastener.

15. A strap configured to attach an electronic device to a user's body, comprising:
- stretchable fabric formed from stretchable intertwined strands, wherein the stretchable intertwined strands each comprise:
  - a core formed from a single elastic strand,
  - a first strand twisted around the core, and
  - a second strand twisted around the first strand and the core, wherein the first and second strands form a covering having a thickness that is greater than a diameter of the core, wherein each of the stretchable intertwined strands has a volume defined by the core, the first strand, and the second strand, and wherein the first strand consumes more of the volume than the core and more of the volume than the second strand.

16. The strap defined in claim 15 wherein the first strand comprises a non-stretchable material.

17. The strap defined in claim 15 further comprising a third strand braided around the second strand, the first strand, and the core.

18. The strap defined in claim 17 wherein the third strand comprises polyester.

* * * * *